US011470960B2

(12) United States Patent
Brown

(10) Patent No.: US 11,470,960 B2
(45) Date of Patent: Oct. 18, 2022

(54) STAND FOR HOLDING AND DISPENSING CRAFT MATERTIALS

(71) Applicant: Susan Brown, Southaven, MS (US)

(72) Inventor: Susan Brown, Southaven, MS (US)

( * ) Notice: Subject to any disclaimer, the term of this patent is extended or adjusted under 35 U.S.C. 154(b) by 0 days.

(21) Appl. No.: 16/949,867

(22) Filed: Nov. 18, 2020

(65) Prior Publication Data

US 2021/0068537 A1 Mar. 11, 2021

Related U.S. Application Data

(63) Continuation-in-part of application No. 16/698,294, filed on Nov. 27, 2019, now Pat. No. 10,856,655, which is a continuation of application No. 16/280,373, filed on Feb. 20, 2019, now Pat. No. 10,524,566.

(60) Provisional application No. 62/632,962, filed on Feb. 20, 2018.

(51) Int. Cl.

| | |
|---|---|
| ***A47B 43/00*** | (2006.01) |
| ***A47B 81/00*** | (2006.01) |
| *B65H 49/32* | (2006.01) |

(52) U.S. Cl.

CPC ..... *A47B 43/00* (2013.01); *A47B 81/007* (2013.01); *B65H 49/321* (2013.01)

(58) Field of Classification Search

CPC ..... A47B 43/00; A47B 81/007; A47B 45/00; A47B 81/00; A47B 46/00; A47B 46/005; A47F 7/17; A47F 5/10; B65H 75/08; B65H 49/321

See application file for complete search history.

(56) References Cited

U.S. PATENT DOCUMENTS 201,328 A * 3/1878 Chamberlin ..... A63B 5/02 482/17
405,264 A * 6/1889 Lindsay ..... B42F 15/0064 402/4
529,439 A * 11/1894 Bent ..... A47F 7/08 211/38
906,347 A * 12/1908 Willner ..... B65H 23/08 242/422.5
1,554,049 A * 9/1925 Thompson ..... D06B 23/00 211/85.5
1,941,428 A * 12/1933 Beardsley ..... D06C 7/00 242/129.6
D136,476 S * 10/1943 Tucker ..... D6/682.2
2,679,321 A * 5/1954 Koeferl ..... B65B 27/083 211/50

(Continued)

*Primary Examiner* — Devin K Barnett
(74) *Attorney, Agent, or Firm* — Dunlap Bennett & Ludwig, PLLC; Anna L. Kinney

(57) ABSTRACT

A stand for holding and dispensing craft materials includes a base having a front, a rear, a first side, a second side, an upper surface, and a lower surface. The base rests on a support surface. A first arm is attached to the first side of the base. A second arm is attached to the second side of the base, spaced apart from the first arm. The arms are perpendicular to the base. Aligned dowel grooves are defined along both the first and the second arm. A ruler is attached to the first second arms parallel to the front of the base and a gap is defined between the base and the ruler. a stand is provided for holding and dispensing rolls of craft materials. The stand includes a dowel. The first and second arms can be attached by hinges to the base upper surface.

6 Claims, 8 Drawing Sheets

(56) References Cited

U.S. PATENT DOCUMENTS 2,940,683 A * 6/1960 Tauber ..... D05C 1/065 242/127
3,143,023 A * 8/1964 Karl ..... B26D 1/205 83/472
3,296,911 A * 1/1967 McLane ..... B26D 1/151 83/408
3,821,915 A * 7/1974 Larrable ..... B26D 1/185 83/174
4,351,208 A * 9/1982 Cobleigh ..... B26D 1/035 156/767
4,978,014 A * 12/1990 Humitz ..... B65D 19/12 108/54.1
5,103,710 A * 4/1992 Ross ..... B26D 1/045 83/485
5,139,160 A * 8/1992 Romano ..... B44C 7/02 211/44
5,242,255 A * 9/1993 Gleffe ..... B65D 19/12 414/403
5,527,242 A * 6/1996 Gangloff ..... A63B 1/005 482/104
5,692,625 A * 12/1997 Filipescu ..... A47B 43/00 211/194
5,894,978 A * 4/1999 Welch ..... B26D 7/14 225/7
5,938,145 A * 8/1999 Dueck ..... B65H 49/325 242/559.4
6,279,763 B1 * 8/2001 Bush ..... A47B 43/00 108/55.1
6,523,776 B1 * 2/2003 Elder ..... B65H 49/32 211/85.5
6,595,462 B2 * 7/2003 Lenski ..... B65H 49/32 242/157 R
6,991,118 B2 * 1/2006 Phillips ..... A47B 47/00 211/85.3
7,098,406 B1 * 8/2006 Hammonds ..... B65H 75/06 174/135
D532,994 S * 12/2006 Rice ..... D6/682.6
7,726,222 B2 * 6/2010 Endresen ..... B65H 35/002 83/76.9
7,866,241 B2 * 1/2011 Yu Chen ..... B26D 1/185 83/649
8,172,099 B1 * 5/2012 Hardy ..... A23G 3/10 211/195
8,342,544 B1 * 1/2013 Blewett ..... B62B 3/022 280/79.11
8,763,505 B2 * 7/2014 Ishihara ..... B26D 7/2621 83/485
8,801,419 B1 * 8/2014 Oskirka ..... A21C 9/02 425/182
8,833,711 B2 * 9/2014 Fritz ..... A47B 95/00 248/201
8,936,166 B2 * 1/2015 Hornsby ..... A47F 5/10 211/85.3
8,955,700 B2 * 2/2015 Barber ..... A47F 7/04 211/195
9,815,657 B1 * 11/2017 Livingston ..... B65H 57/10
2005/0000340 A1 * 1/2005 Petersen ..... B26D 1/045 83/485
2005/0103730 A1 * 5/2005 Hosilyk ..... A47F 7/17 211/85.5
2005/0120850 A1 * 6/2005 Loibl ..... B26D 1/185 83/485
2006/0091096 A1 * 5/2006 Velez ..... B62B 3/10 211/194
2007/0125214 A1 * 6/2007 Dong ..... B26D 1/205 83/485
2007/0131634 A1 * 6/2007 Markle ..... A47G 1/12 211/189
2007/0169602 A1 * 7/2007 Peterson ..... B26D 7/015 83/485
2008/0034936 A1 * 2/2008 Loibl ..... B26D 7/025 83/455
2008/0217276 A1 * 9/2008 Brady ..... B65D 19/12 211/195
2008/0237168 A1 * 10/2008 Harpole ..... B65D 19/12 211/195
2009/0065457 A1 * 3/2009 Kostigian ..... B62B 3/104 211/85.5
2009/0159475 A1 * 6/2009 Limber ..... A47F 7/0028 206/391
2011/0174754 A1 * 7/2011 Entz ..... A63B 71/0045 211/202
2011/0180505 A1 * 7/2011 Noniewicz ..... B27B 21/00 211/195
2011/0226888 A1 * 9/2011 Jacquart ..... A47F 7/17 242/564.5
2014/0014607 A1 * 1/2014 Mikich ..... A47B 96/027 211/195
2014/0339183 A1 * 11/2014 Cash ..... A47B 81/007 211/85.5
2016/0007744 A1 * 1/2016 Fasino ..... A47F 7/005 312/330.1
2019/0254421 A1 * 8/2019 Brown ..... B65H 49/325

* cited by examiner

STAND FOR HOLDING AND DISPENSING CRAFT MATERTIALS

CROSS-REFERENCE TO RELATED APPLICATION

This application is a continuation-in-part application of U.S. non-provisional application Ser. No. 16/698,294, filed Nov. 27, 2019, which is a continuation application of U.S. non-provisional application Ser. No. 16/280,373, filed Feb. 20, 2019, which claims the benefit of priority of U.S. provisional application No. 62/632,962, filed Feb. 20, 2018. This application claims priority of U.S. application Ser. Nos. 16/698,294, 16/280,373, and 62/632,962, the contents of which are incorporated herein by reference in their entireties.

BACKGROUND OF THE INVENTION

The present invention relates to home crafting and, more particularly, to a stand for holding and dispensing craft materials.

Crafting with decorative mesh, ribbons and other materials that are dispensed on a spool can be difficult to manage. This is due to the products curling and rolling away from one while attempting to measure and cut materials. Crafting with spooled materials that roll can be frustrating and contribute to a messy unorganized workspace.

Current products on the market that dispense spooled materials are for industrial use. These devices are too large and insufficient for home crafting use. They also do not dispense multiple rows of materials at once, nor do any of the current products collapse.

As can be seen, there is a need for a stand for holding and dispensing craft materials.

SUMMARY OF THE INVENTION

In one aspect of the present invention, a stand is provided for holding and dispensing rolls of craft materials. The stand comprises a substantially planar base comprising a front, a rear, a first side, a second side, an upper surface, and a lower surface, wherein the substantially planar base is configured to rest upon a support surface; a first arm attached to the first side of the substantially planar base and perpendicular thereto, having at least one first dowel groove defined therein; a second arm attached to the second side of the substantially planar base and perpendicular thereto, having at least one second dowel groove defined therein; and a ruler attached to the first arm and the second arm such that the ruler is substantially parallel to the front of the substantially planar base. The first arm is spaced apart from the second arm; the at least one first dowel groove aligns with the at least one second dowel groove; and a gap is defined along the front of the substantially planar base adjacent to the ruler.

In another aspect of the invention, a stand is provided for holding and dispensing rolls of craft materials. The stand comprises a substantially planar base comprising a front, a rear, a first side, a second side, an upper surface, and a lower surface, wherein the substantially planar base is configured to rest upon a support surface; a first arm hingedly attached to the upper surface of the substantially planar base, having at least one first dowel groove defined therein; a second arm hingedly attached to the upper surface of the substantially planar base, having at least one second dowel groove defined therein; at least one dowel; and a ruler attached to the front of the substantially planar base. The first arm is spaced apart from the second arm; the at least one first dowel groove aligns with the at least one second dowel groove; and a gap is defined along the front of the substantially planar base adjacent to the ruler.

These and other features, aspects and advantages of the present invention will become better understood with reference to the following drawings, description, and claims.

DETAILED DESCRIPTION OF THE INVENTION

Figure 1:
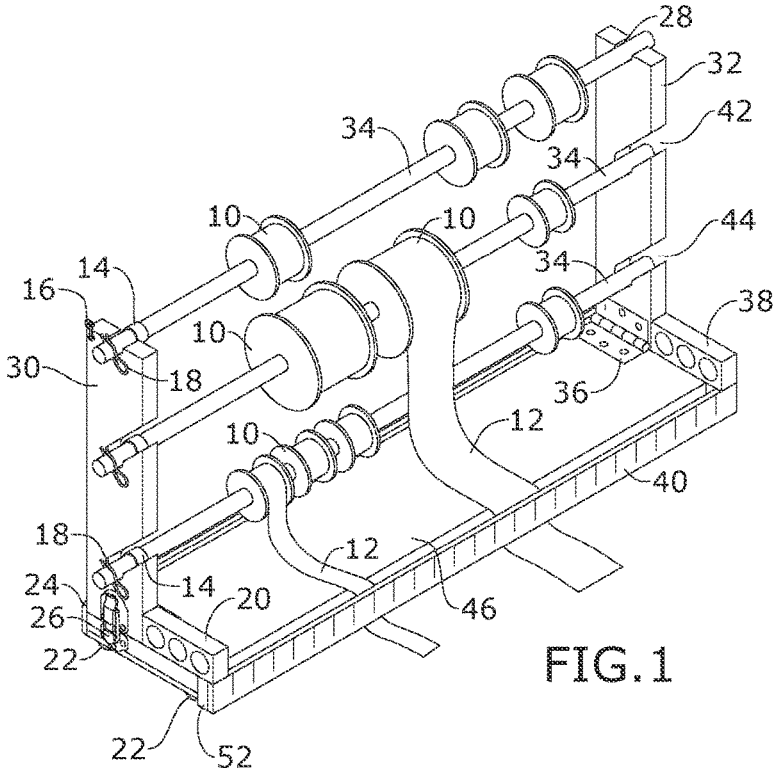
FIG. 1 is a perspective view of a collapsible embodiment of the present invention in use.
Figure 2:
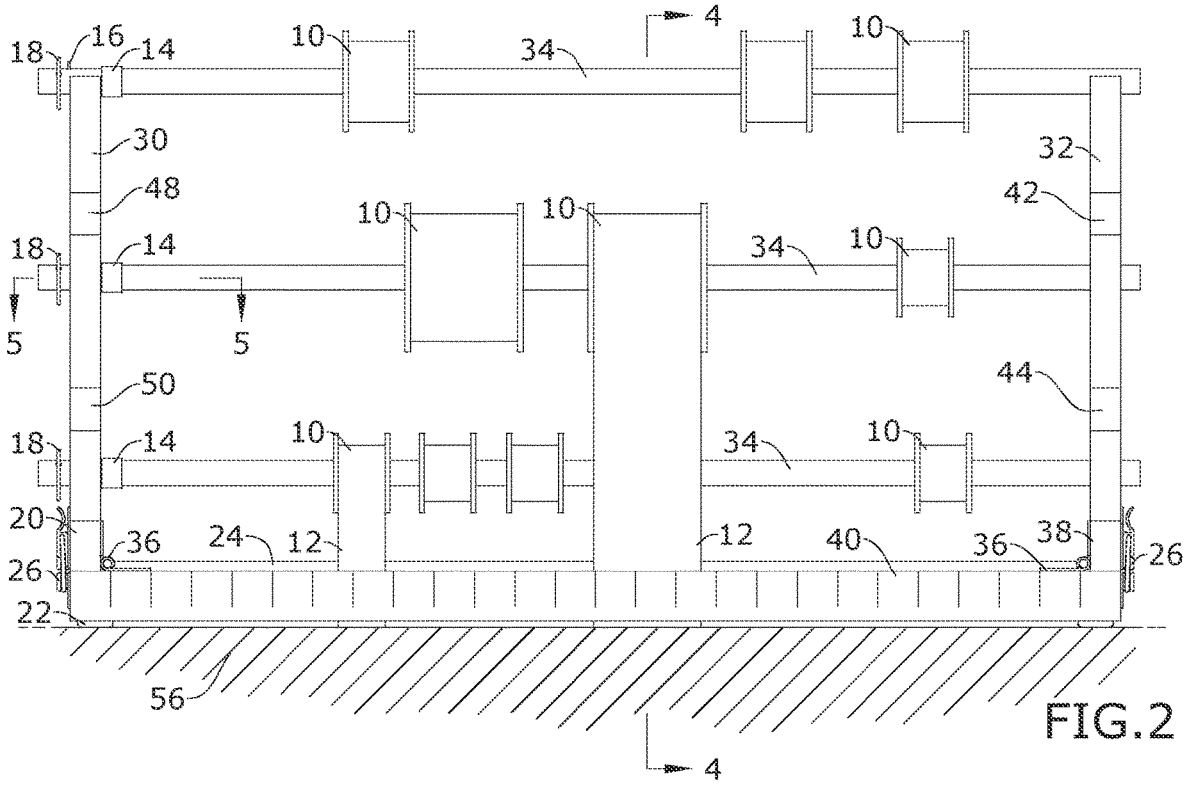
FIG. 2 is a front elevation view thereof, shown in use.
Figure 3:
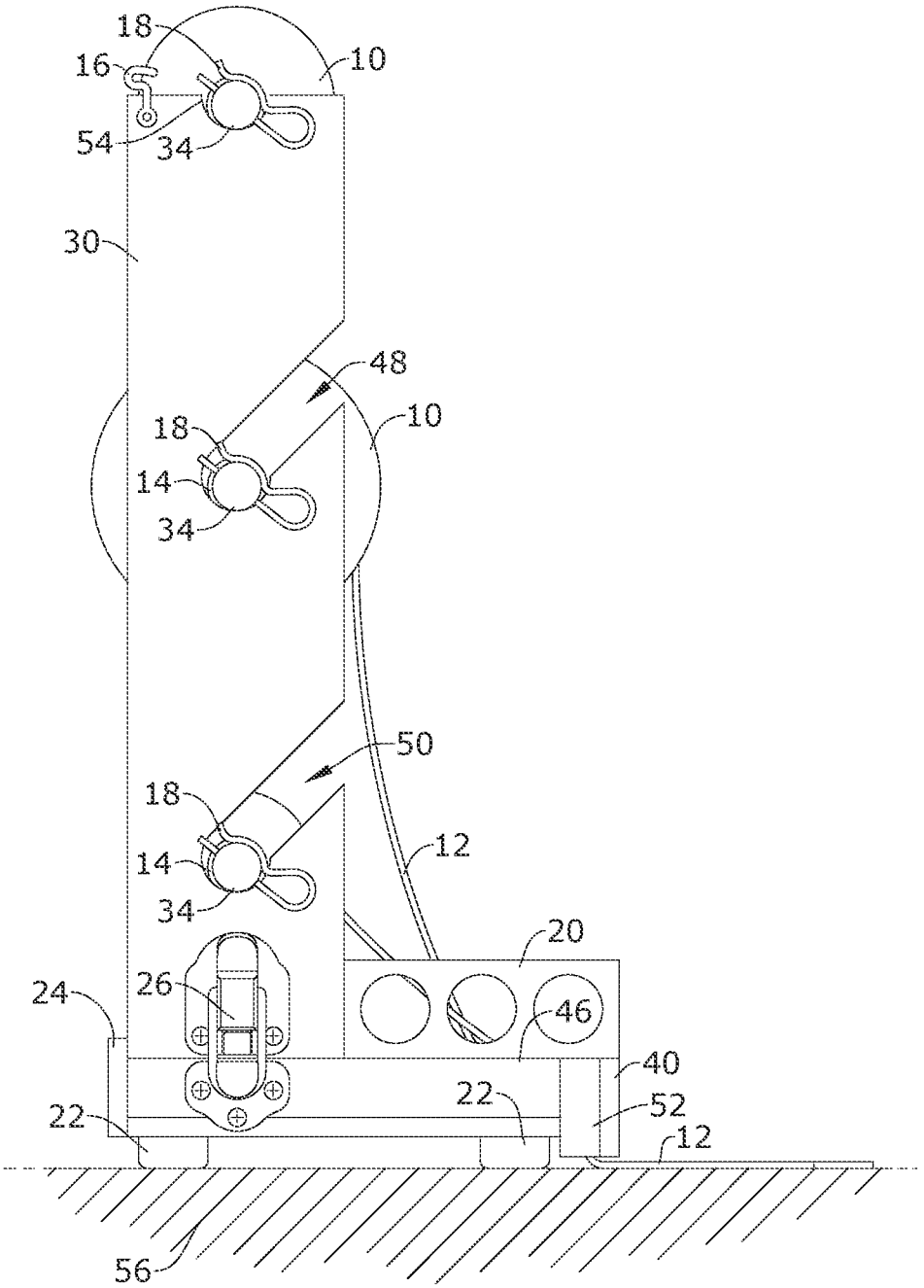
FIG. 3 is a left side elevation view thereof, shown in use.
Figure 4:
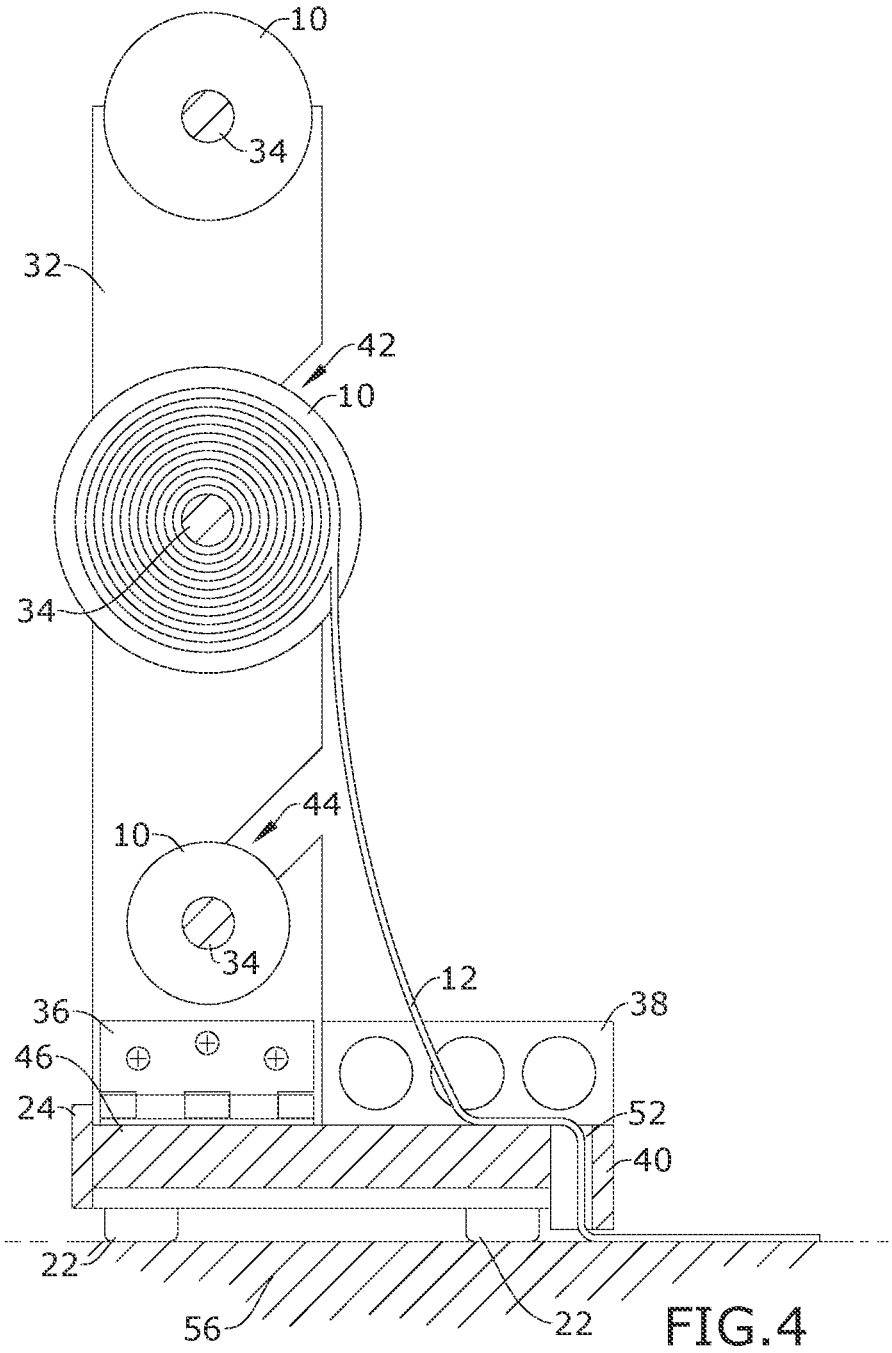
FIG. 4 is a sectional view thereof, taken along line 4-4 in FIG. 2.
Figure 5:
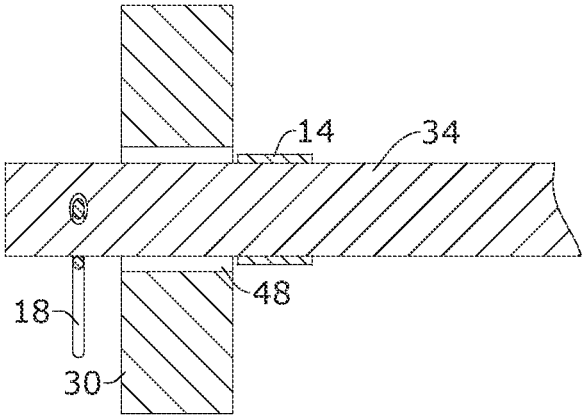
FIG. 5 is a partial sectional view thereof, taken along line 5-5 in FIG. 2.
Figure 6:
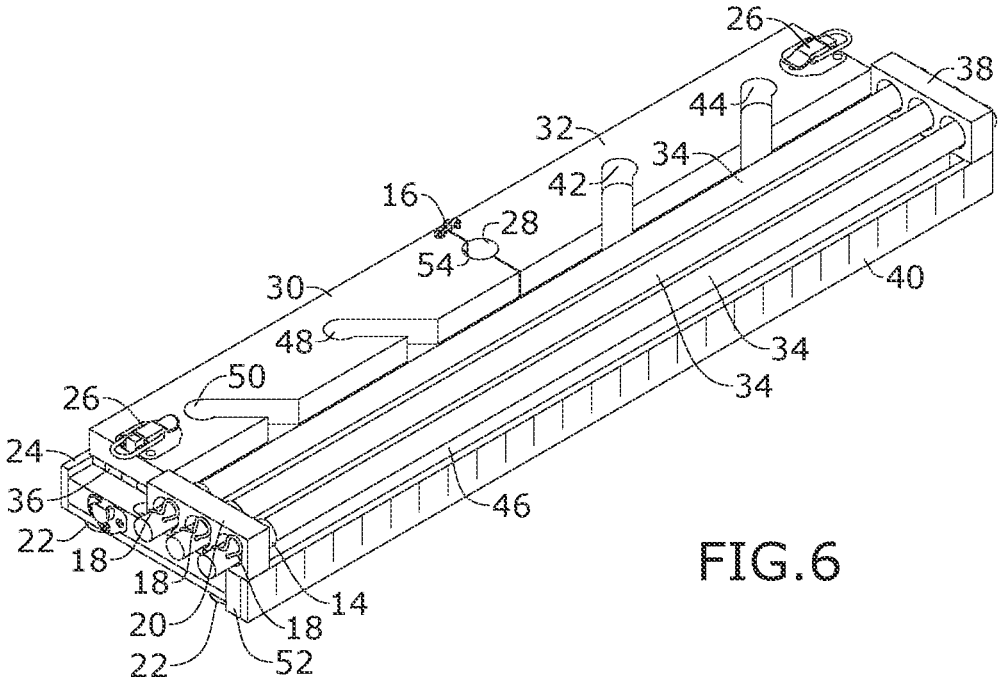
FIG. 6 is a perspective view thereof, shown in a collapsed configuration.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

The present invention includes a stand for holding and dispensing crafting materials, such as deco mesh, ribbons, and the like. This mesh roller, holder, and stand easily holds multiple rolls of crafting materials and neatly dispenses materials without curling to make cutting and measuring easier. The stand provides easy access and organization of crafting materials. In some embodiments, the present invention further collapses for easy storage when not in use.

Referring to FIGS. 1 through 15, the present invention includes a collapsible stand for holding and dispensing craft materials. The stand includes a base 46 having a front, a rear, a first side, a second side, an upper surface, and a lower surface. The base may be configured to rest on a support surface. A first arm 30 is coupled to the upper surface at the first side of the base 46 by a first hinge 36. At least one first dowel slot 48, 50, 54 is defined through the first arm 30. A second arm 32 is coupled to the upper surface at the second side of the base 46 by a second hinge 36. At least one second dowel slot 28, 42, 44 is defined through the second arm 32.

The collapsible stand includes an expanded configuration and a collapsed configuration. The expanded configuration includes the first arm 30 and the second arm 32 pivoted upward from the base 46 in a vertical position so that the first dowel slot 48, 50, 54 aligns with the second dowel slot 28, 42, 44, and the collapsed configuration includes the first arm 30 and the second arm 32 pivoted downward towards the base 46 in a horizontal position.

In certain embodiments, the present invention includes a first lock 26 configured to releasably lock the first arm 30 in the expanded configuration and a second lock 26 configured to releasably lock the second arm in the expanded configuration. The first lock 26 and the second lock 26 may be any type of lock that releasably holds the first arm 30 and the second arm 32 in a vertical position relative to the base 46. For example, the first lock 26 and the second lock 26 may each include draw catches coupled to the first side and the second side of the base 46 and the outer edge of the first arm 30 and the second arm 30.

The present invention may further include a collapse lock 16 configured to lock the first arm 30 to the second arm 32 in the collapsed configuration. The collapse lock 16 may be any type of lock that releasably holds the first arm 30 and the second arm 32 in a horizontal position relative to the base 46. For example, the collapse lock 16 may include a hook coupled to a top end of the first arm 30 and a loop coupled to the top end of the second arm 32. When the first arm 30 and the second arm 32 are pivoted towards one another in the collapsed configuration, the hook may rotate into the loop, locking the first arm 30 and the second arm 30 together.

In certain embodiments, the at least one first dowel slot 48, 50, 54 includes a first top slot 54 defined on an upper edge of the first arm 30, a first bottom slot 50, and a first middle slot 48 defined in between the first top slot 54 and the first bottom slot 50. The at least one second dowel slot 28, 42, 44 includes a second top slot 28 defined on an upper edge of the second arm 32, a second bottom slot 44, and a second middle slot 42 defined in between the second top slot 28 and the second bottom slot 44. The first top slot 54 and the second top slot 28 align in the expanded configuration, the first bottom slot 50 and the second bottom slot 44 align in the expanded configuration, and the first middle slot 48 and the second middle slot 42 align in the expanded configuration.

The first middle slot 48 and the first bottom slot 50 may each be defined starting from an outer edge of the first arm 30 and angle downwards towards a longitudinal axis of the first arm 30. An opening may be defined as an entrance into the first middle slot 48 and the first bottom slot 50 at the outer edge of the first arm 30. Further, the second middle slot 42 and the second bottom slot 44 are each defined starting from an outer edge of the second arm 32 and angle downwards towards a longitudinal axis of the second arm 32. An opening may be defined as an entrance into the second middle slot 42 and the second bottom slot 44 at the outer edge of the second arm 32.

The present invention may further include at least one dowel 34. The dowel 34 is an elongated cylindrical rod to hold rolls 10 of craft material 12, such as ribbon or mesh material. The dowel 34 fits within the at least one first dowel slot 48, 50, 54 and the at least one second dowel slot 28, 42, 44 in the expanded configuration. In certain embodiments, the present invention may include three or more dowels 34. In such embodiments, each of the dowels 34 fits within a different pair of the aligned dowel slots 48, 50, 54, 28, 42, 44 of the first arm 30 and the second arm 32 in the expanded configuration.

The present invention may further include dowel locks 14, 18 configured to releasably retain the dowels 34 within the first dowel slots 48, 50, 54, and the second dowel slot 28, 42, 44. The dowel locks 14, 18 may include any type of lock that releasably retains the dowels within the first dowel slots 48, 50, 54, and the second dowel slot 28, 42, 44 in the expanded configuration. For example, the dowel locks 14, 18 may be include a ring disposed around the respective dowel 34 having a larger circumference than the dowel slots 48, 50, 54, 28, 42, 44, and a dowel lock or cotter pin 18 disposed through an opening of the respective dowel 34.

The present invention may further include a first dowel holder 20 coupled to the upper surface at the front and first side of the base 46 with at least a first dowel holder opening, and a second dowel holder 38 coupled to the upper surface at the front and second side of the base 46 with at least one second dowel holder opening. In certain embodiments, each of the first dowel holder 20 and the second dowel holder 38 may include two, three or more openings. Each of the openings of the first dowel holder 20 align with the openings of the second dowel holder 38. Dowels 34 fit within the aligned dowel holder openings of the first and second dowel holders 20, 38 in the collapsed configuration.

The present invention may further include a backing 24 coupled to the rear of the base 46 and a ruler 40 coupled to the front of the base 46. The ruler 40 may be coupled to the front of the base 46 by spacers 52 so that a gap is defined between the ruler 40 and the base 46. A plurality of rubber feet 22 may be coupled to the lower surface of the base 46, thereby elevating the lower surface of the base 46 above a surface 56 in which the feet 22 are resting. This allows the material 12 supported by the dowels 34 to be rolled off the rolls 10, run through the gap, and under the ruler 40 to be measured and cut. The gap between the ruler 40 and the base 46 holds the materials close to the work surface 56 preventing materials from curling for easy cutting and measuring.

The collapsible stand for holding and dispensing craft materials is designed to help crafters that work with spooled materials such as deco mesh, ribbons, stabilizers, fabrics, craft paper, and the like. The crafter places rolls 10 of material 12 onto the dowels 34. The material 12 is then guided down into the gap between the base 46 and ruler 40 and is then pulled out along the work surface 56. The ruler 40 guides the material close to the surface 56. The multiple dowels 34 and levels provide ample space for working with multiple materials 12 at once. This can save a lot of time for the crafter as well as prevent frustration of working with materials 12 that curl up while working with them. The non-slip feet 22 keep the stand secure while working. The present invention conveniently collapses and folds away for easy storage and allows for portability while traveling to crafting events.

Figure 7:
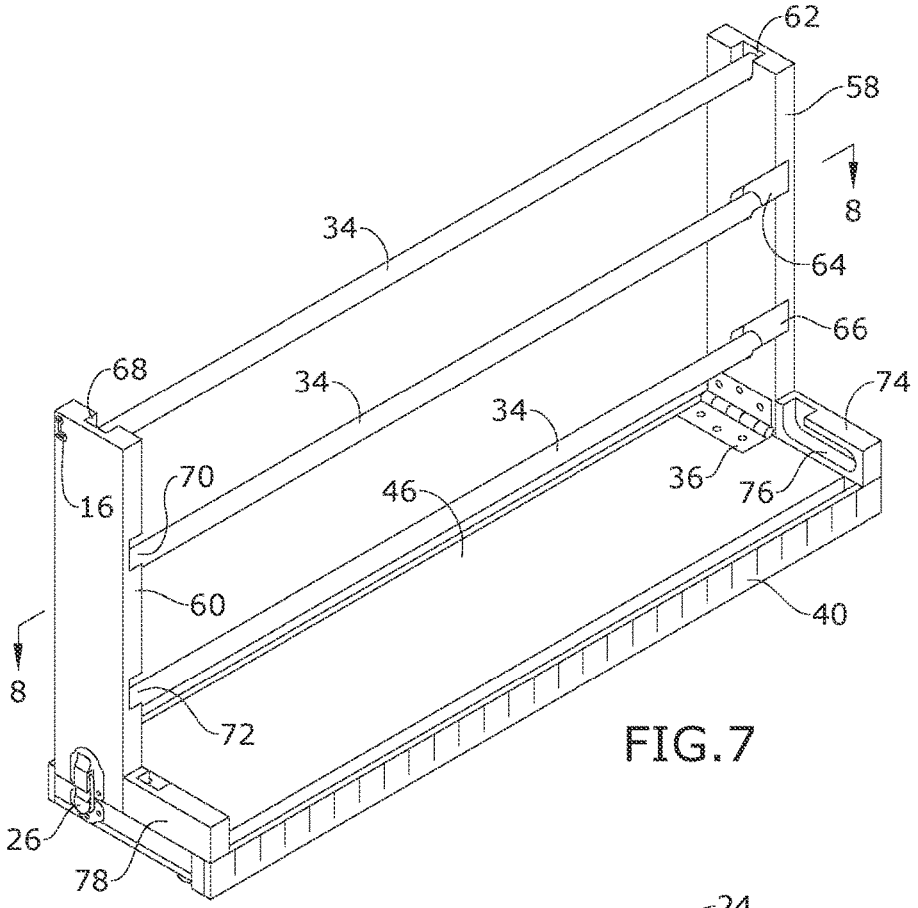
FIG. 7 is a perspective view of another collapsible embodiment of the present invention.
Figure 8:
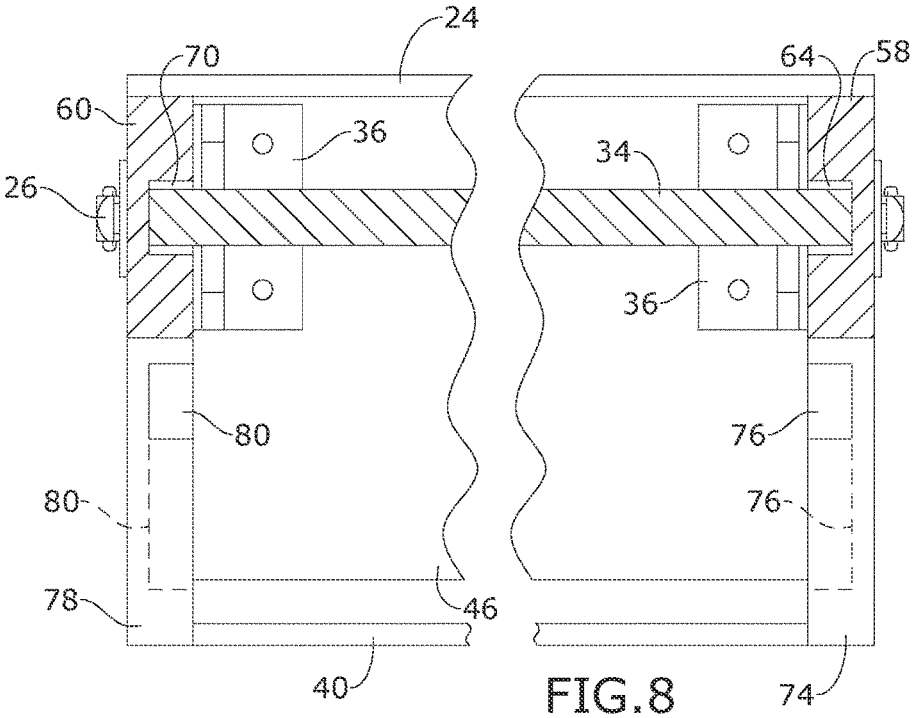
FIG. 8 is a sectional view thereof, taken along line 8-8 in FIG. 7.
Figure 9:
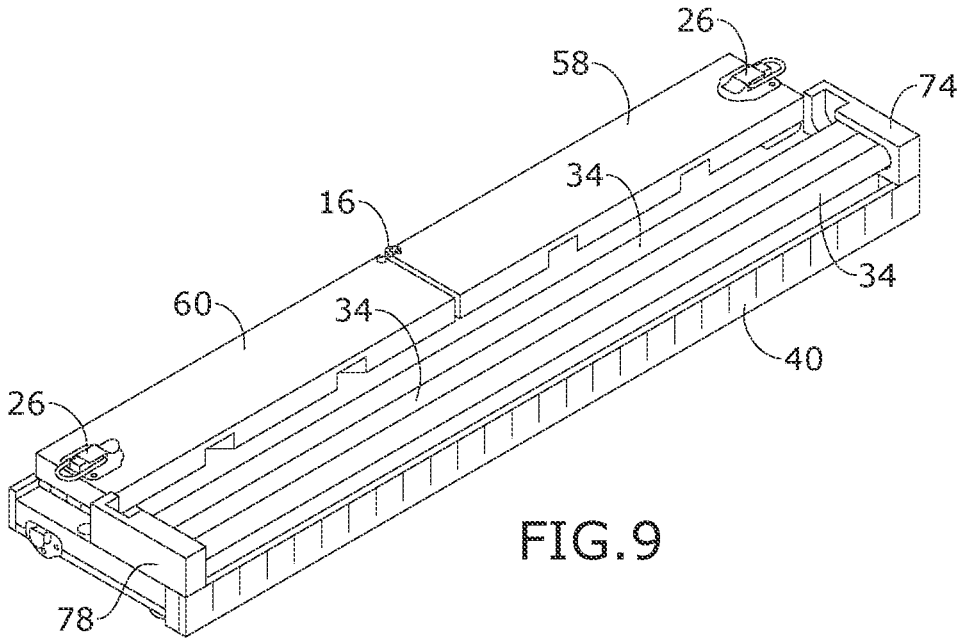
FIG. 9 is a perspective view thereof, shown in a collapsed configuration.

FIGS. 7 through 9 illustrate an embodiment of the present invention having a first arm 58, with a top dowel groove 62, a middle dowel groove 64, and a bottom dowel groove 66 formed therein, and a second arm 60, with a corresponding top groove 68, middle groove 70, and bottom groove 72 formed therein, hingedly attached to the substantially planar base 46 by hinges 36. The first arm 58 and the second arm 60 are spaced apart in the expanded position sufficiently wide to accept a dowel within any aligned pair of the dowel grooves. Generally, the top dowel grooves 62, 68 align, the middle dowel grooves 64, 70 align, and the bottom dowel grooves 66, 72 align. When the stand is moved into expanded configuration, the dowels 34 may slide into the dowel grooves 62 and 68, 64 and 70, and 66 and 72 to be held securely therein. No additional hardware such as dowel locks is necessary to hold the dowels in place. The base 46 may have a first dowel holder 74 with a first dowel storage groove 76 and a second dowel holder 78 with a second dowel storage groove 80. The dowel storage grooves may be defined by a front wall, a rear wall, a lower wall, and a gapped upper wall. When the stand is moved into collapsed configuration, the dowels 34 may be slid into the first and second dowel storage grooves 76, 80 for secure storage until the next use. When in use, the dowels 34 may extend through rolls of craft materials and between the two arms 58, 60. The base 46 and the adjacent ruler 40 generally accommodate craft materials rolled off of the rolls by passing the materials through the gap between the ruler 40 and the base 46 and then by passing the materials under the ruler 40.

Figure 10:
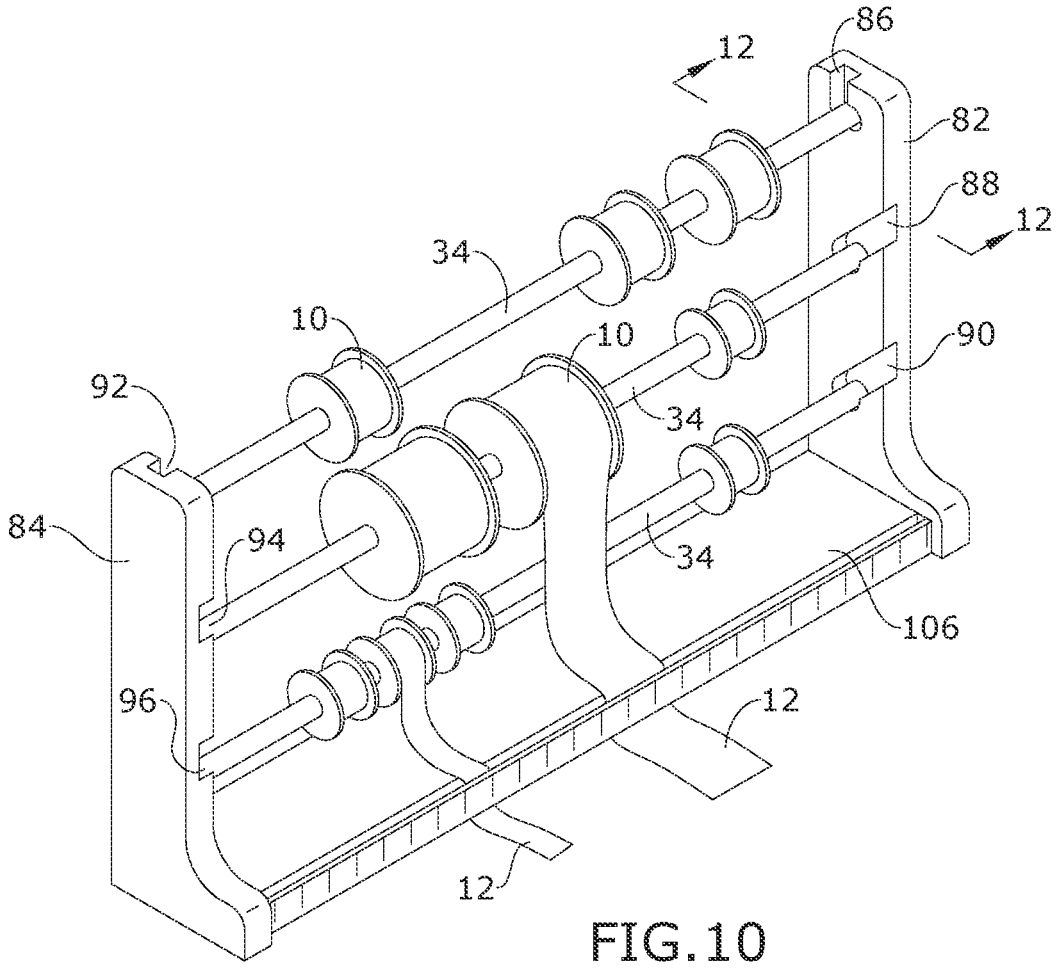
FIG. 10 is a perspective view of another embodiment of the present invention.
Figure 11:
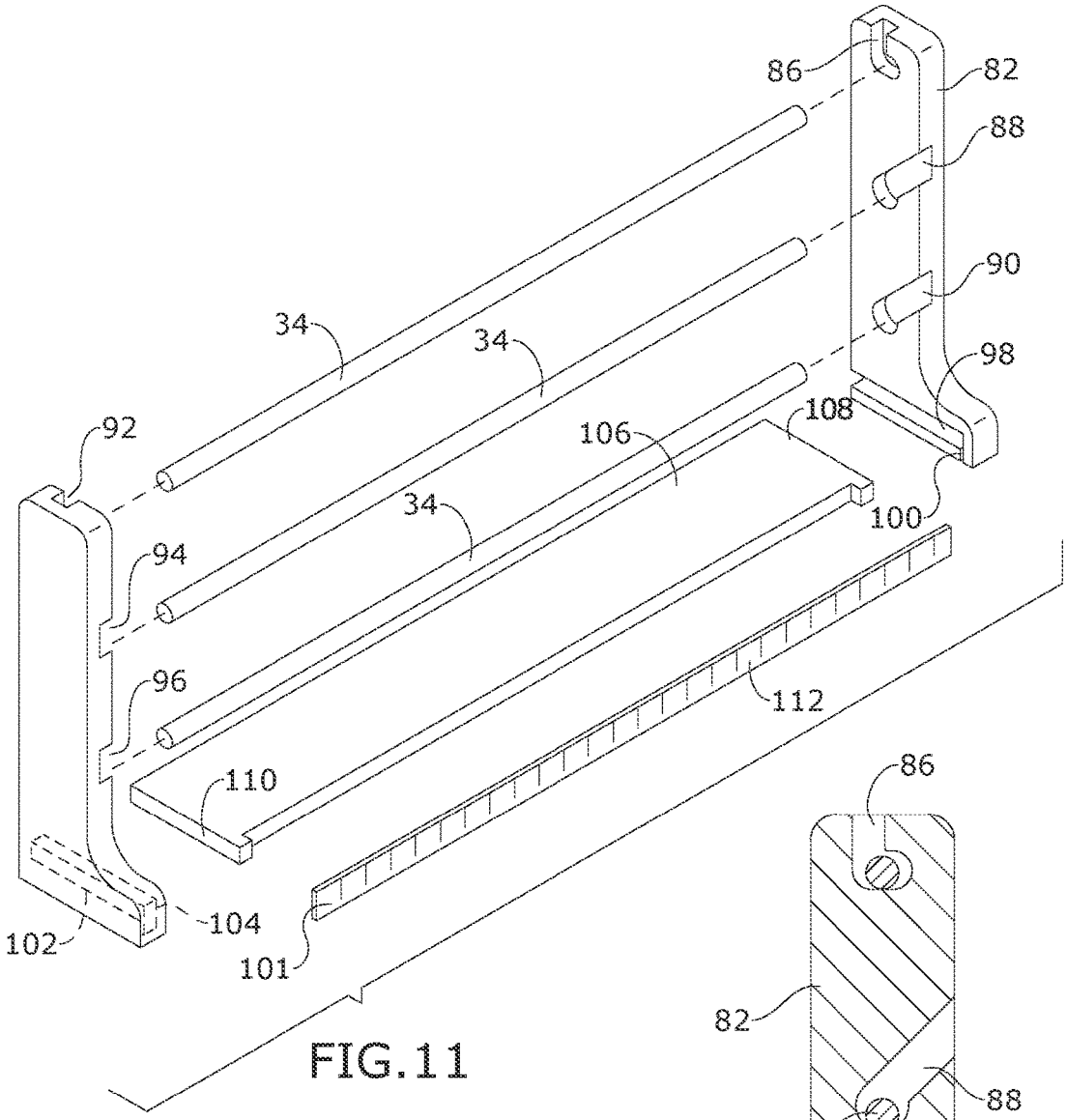
FIG. 11 is an exploded view thereof.
Figure 12:
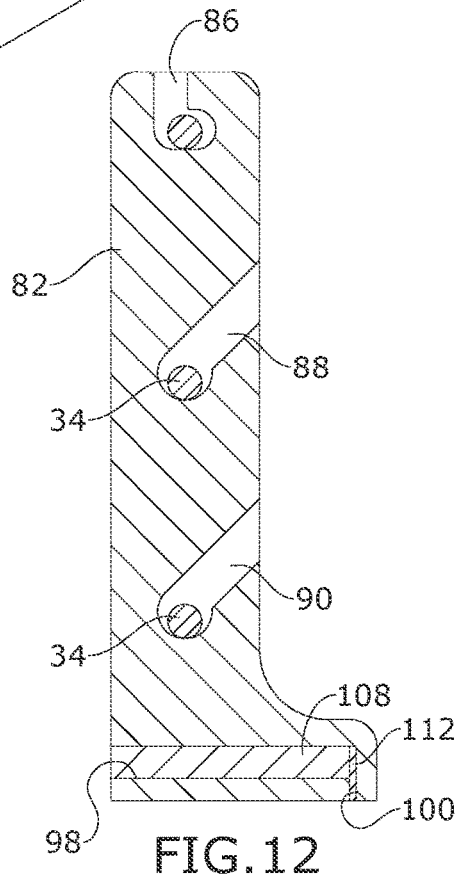
FIG. 12 is a sectional view thereof, taken along line 12-12 in FIG. 10.

FIGS. 10 through 12 show another embodiment of the present invention. The base 106 is shown attached to a first arm 82 and a second arm 84, with each end 101 of the base 106 held within base assembly grooves 98, 102 on the arms 82, 84. The arms 82, 84, may be positioned perpendicular to the base 106. The arms may have a plurality of dowel grooves 86, 88, 90, 92, 94, 96 to hold dowels 34. As shown in the Figures, the arms 82, 84 have ruler assembly grooves 100, 104 within which a ruler 110 is attached substantially parallel to the base 106. The base 106 may have a front longitudinal portion cut away such that each end of the front longitudinal portion protrudes, acting as spacers to form a gap between the base 106 and the ruler 110. The base 106 and the ruler 110 may be attached to the arms 82, 84 by any suitable means, such as but not limited to friction, glue, or nails.

Figure 13:
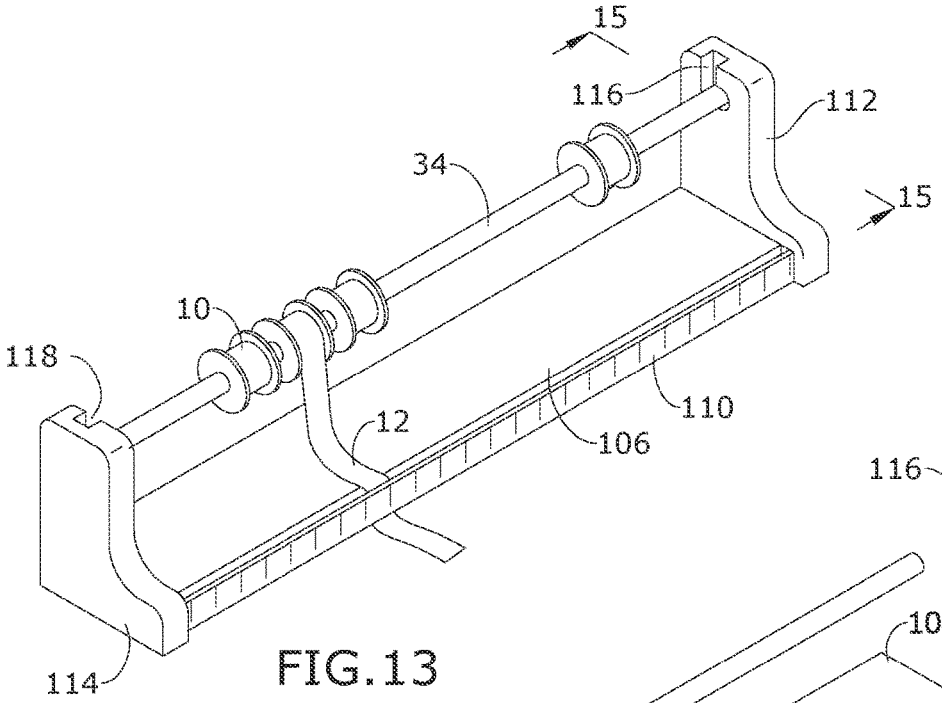
FIG. 13 is a perspective view of another embodiment of the present invention, shown in use.
Figure 14:
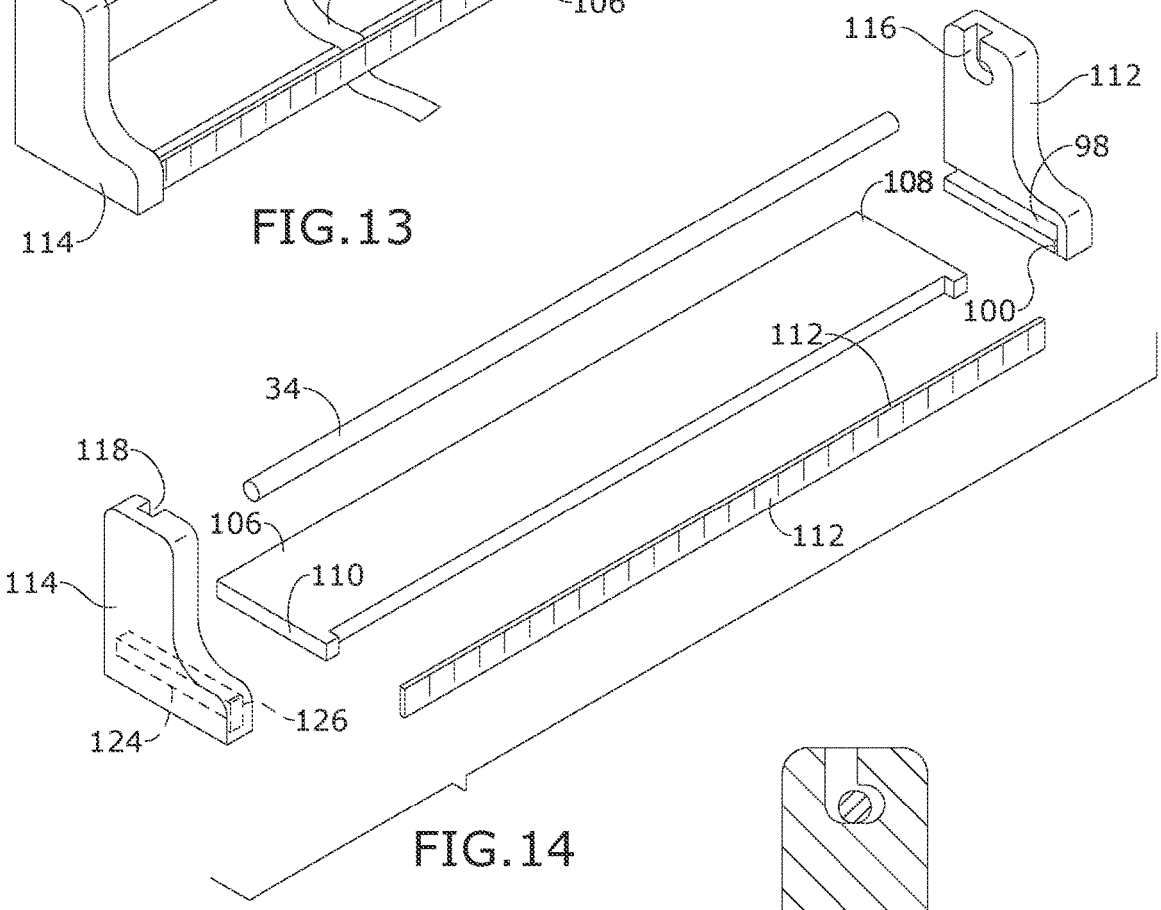
FIG. 14 is an exploded view thereof.
Figure 15:
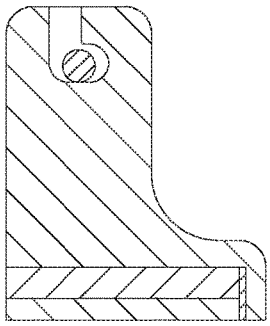
FIG. 15 is a sectional view thereof, taken along line 15-15 in FIG. 13.

As shown in FIGS. 13 through 15, in some embodiments, a first and second stand arm 112, 114 each may have a single dowel groove 116, 118, respectively, for use with a single dowel 34. The base 106 may be attached to the arms 112, 114 within base assembly grooves 98, 124 and a ruler 110 may be attached to the arms 112, 114 within ruler assembly grooves 100, 126, in a manner discussed above.

Embodiments of the invention as illustrated in FIGS. 10 through 15 may further include dowel storage with a first and a second dowel holder attached to the base, as illustrated in FIGS. 7 through 9.

A method of making the present invention may include the following. Cut the wood base to spec and sand. Front facing top of base is rounded smooth. A peg hole is drilled in base on front facing left side. The front facing ruler is cut. The back side bottom corner of the ruler is rounded. The ruler is nailed and glued to front of base with printed side out, using the wooden spacers between ruler and the base. The side arms are cut and sanded. The edges of the side arms are slightly rounded. The dowel holes in the side arms are measured, drilled, and sanded. The side arms are attached to each end of the base using the hinges. Hinges are offset from the end of base to allow side arms to stand in a straight upright position flush with the base. The hinges are screwed to the base and side arm. The ruler is mounted to the back of the base to provide a finished cohesive look. The back ruler is blank side facing out. The wooden side strips are cut and nailed and/or glued to the bottom of the base at each end. This strip is for added height and where the non-slip feet are mounted. The draw catch is in two pieces and are placed, one at the base of a side arm and screwed into place while the other piece is attached to the base using screws. When the side arms are in an upright position, the latch top connects to the latch bottom and secures the arms in place. The hook and staple are in two pieces. Each piece is attached to outside top of each arm. When arms are in collapsed position, the hook and staple connect. The hook and staple are screwed into place. Three dowel rods are cut and sanded. On one end of dowel a hole is drilled, and a cotter pin is inserted. On the same end of each dowel a copper ring is attached to rod. The dowel holders are cut, and the holes are cut and sanded. The dowel holders are glued and/or nailed to each end of top of front facing base overlapping the ruler and spacer on the front.

A method of using the present invention may include the following. Place a roll or spool of material on a dowel rod with the material rolling up and over front of spool. Guide the material down into the space between the base and the ruler, then pull out a over worktable or cutting mat. The ruler is there as a guide and keep the material low and close to the cutting mat pulling and cutting as you go. The multiple dowels and levels provide ample space for working with multiple materials at once and allows simultaneous measuring and cutting. This can save a lot of time for the crafter as well as prevent frustration of working with materials that curl up while working with them. The non-slip feet are very helpful for keeping the unit secure while working. The unit collapses down by unhooking the side arms and laying them flat. The hook and staple secure the side arms in folded position if being stored vertically.

It should be understood, of course, that the foregoing relates to exemplary embodiments of the invention and that modifications may be made without departing from the spirit and scope of the invention as set forth in the following claims.

What is claimed is:

1. A stand for holding and dispensing rolls of craft materials comprising:

a substantially planar base comprising a front, a rear, a first side, a second side, an upper surface, and a lower surface, wherein the substantially planar base is configured to rest upon a support surface;

a first arm attached to the first side of the substantially planar base and perpendicular thereto, the first arm having a length, a width, at least one first dowel groove defined therein, and a first base assembly groove defined therein, wherein the first base assembly groove extends along a substantial portion of the width of the first arm and the first side of the base is in the first base assembly groove;

a second arm attached to the second side of the substantially planar base and perpendicular thereto, the second arm having a length, a width, at least one second dowel groove defined therein, and a second base assembly groove defined therein, wherein the second base assembly groove extends along a substantial portion of the width of the second arm and the second side of the base is in the second base assembly groove; and a ruler attached to the first arm and the second arm such that the ruler is substantially parallel to the front of the substantially planar base; wherein the first arm is spaced apart from the second arm; the at least one first dowel groove aligns with the at least one second dowel groove; and a gap is defined between the front of the substantially planar base and the ruler.

2. The stand of claim 1, wherein the at least one first dowel groove comprises a first top groove defined on an upper edge of the first arm, a first bottom groove, and a first middle groove defined in between the first top groove and the first bottom groove, wherein the at least one second dowel groove comprises a second top groove defined on an upper edge of the second arm, a second bottom groove, and a second middle groove defined in between the second top groove and the second bottom groove, wherein the first top groove and the second top groove align, the first bottom groove and the second bottom groove align, and the first middle groove and the second middle groove align.

3. The stand of claim 2, wherein the first middle groove and the first bottom groove are each defined along a first surface starting from an outer edge of the first arm and angle downwards towards a longitudinal axis of the first arm, and the second middle groove and the second bottom groove are each defined along an opposed second surface starting from an outer edge of the second arm and angle downwards towards a longitudinal axis of the second arm.

4. The stand of claim 1, further comprising at least one dowel, wherein the at least one dowel extends between the first arm and the second arm and fits within the at least one first dowel groove and the at least one second dowel groove, wherein the at least one dowel is configured to extend through the rolls of craft materials to store the rolls of craft materials thereon.

5. The stand of claim 1, wherein the ruler and the substantially planar base are configured to accommodate craft materials from the rolls of craft materials such that the craft materials pass through the gap between the substantially planar base and the ruler and pass underneath the ruler.

6. The stand of claim 1, further comprising a plurality of feet coupled to the lower surface of the substantially planar base.

* * * * *